United States Patent [19]

Gelbard

[11] Patent Number: 4,943,167

[45] Date of Patent: Jul. 24, 1990

[54] PLASTIC BAG AND METHOD AND APPARATUS OF MANUFACTURE

[75] Inventor: Edward Gelbard, Monte Carlo, Monaco

[73] Assignee: Hilex Poly Company, Inc., Los Angeles, Calif.

[21] Appl. No.: 38,234

[22] Filed: Jun. 12, 1987

Related U.S. Application Data

[62] Division of Ser. No. 801,752, Nov. 26, 1985.

[51] Int. Cl.[5] ..... B65D 33/06

[52] U.S. Cl. ..... 383/8; 383/107; 383/120; 383/903

[58] Field of Search ..... 383/8, 107, 108, 120, 383/903

[56] References Cited

U.S. PATENT DOCUMENTS

| | | | |
|---|---|---|---|
| 2,465,044 | 3/1949 | Shumann . | |
| 3,185,044 | 5/1965 | Ahlbrandt . | |
| 3,566,756 | 3/1971 | Schmid et al. . | |
| 4,526,565 | 7/1985 | Hummel et al. | 493/211 |
| 4,529,090 | 7/1985 | Pilon | 383/8 |

FOREIGN PATENT DOCUMENTS

| | | |
|---|---|---|
| 1185045 | 1/1965 | Fed. Rep. of Germany . |
| 794999 | 5/1958 | United Kingdom . |
| 1046431 | 10/1966 | United Kingdom . |
| 1215715 | 12/1970 | United Kingdom . |

*Primary Examiner*—Stephen P. Garbe

[57] ABSTRACT

Disclosed is a bag including a front wall and a rear wall and having an open mouth portion in which the front wall and rear wall are joined by pleated portions or gussets. The bag is manufactured so that a longitudinal, thermally welded seam is placed inside a portion of at least one of the gussets at a point other than the central fold. The bag preferably includes handles which are integral extensions of the front and rear walls and the gussets. The bag manufactured according to the principles of the present invention thus eliminates or minimizes failure of thermally welded seams.

Also disclosed is a method for manufacturing the bags and an apparatus for manufacturing the bags.

1 Claim, 2 Drawing Sheets

PLASTIC BAG AND METHOD AND APPARATUS OF MANUFACTURE

This is a division of application Ser. No. 801,752, filed Nov. 26, 1985.

FIELD OF THE INVENTION

This invention pertains to thermoplastic bags and more specifically to a method of manufacturing a thermoplastic bag having a thermally welded seam extending along the length of the bag so as to avoid stress concentration along the thermally welded seam.

BACKGROUND OF THE INVENTION

In the past, bags for use by consumers, such as shopping bags, have been manufactured from paper. Recently, such bags have been replaced for many purposes by thermoplastic bags, particularly those manufactured from polyethylene. Such polyethylene bags have strength characteristics, particularly when wet, not normally found in paper bags. Additionally, paper bags ordinarily have carrying handles near the open mouth portion of the bag which are constructed from separate handle elements, distinct from the bag structure. In plastic bags, the handles may be formed as integral extensions of the bag sides or walls. Plastic bags of this configuration are sometimes known as "t-shirt" bags.

Plastic bags may be manufactured to include integral tabs which are attached to the main bag body by a perforated area. Individual bags are conveniently formed into stacks with their tabs joining, as by stapling, to form a bag pack or unit. Individual bags may be separated by tearing them away at the perforation.

A bag for use in a bag pack structure is disclosed in U.S. Pat. No. 4,165,832, which describes a plastic bag having handles shaped to be wider at the top to reduce the tendency for the bag handles to curl into a small cross-sectional area in the user's palm. This bag additionally includes stress relief notches at the point of attachment of the handles to the bag mouth to minimize the likelihood of tearing away the handles as a result of stress concentration.

Plastic bags of the type under consideration have typically been manufactured from a continuous tube of thin thermoplastic material, such as polyethylene, by a process including cutting sections of the tube to form the general shape of the bag, folding to form side "gussets" or pleats, and thermal welding to form the handles and the closed bottom of the bag.

Recently, it has become practical to manufacture tubes (also known as webs) of polyethylene having a substantially larger diameter than was previously practical. Such larger tubes may have, for example, three times the circumference (or more) of the tubes previously used in the manufacture of bags. These larger tubes may be sliced rapidly into lengthwise sections from which smaller tubes may be formed simultaneously. For example, a single tube may be cut into three lengthwise sections to form three individual tubes and subsequent bag manufacturing operations can occur simultaneously instead of successively. Up to three times as many bags may be made in the period of time previously required to manufacture one.

Further, the cost of the extruder used to manufacture the tube, or web, is relatively high compared to other components of the plastic bag manufacturing line. Thus, it is highly cost effective to use a single extruder to produce a web which can be slit-sealed into multiple smaller webs, rather than operating multiple extruders producing the smaller webs directly. Thus, thermoplastic bags manufactured from the larger tubes may be made at a substantially lower cost.

Where three smaller diameter webs are formed from a single large web, the two outer webs have one seal and the middle one has two. The seals are positioned at the innermost or central fold of the gussets formed at the sides of the bag. These sealed folds are subjected to substantial stress when the bag is filled during use and represent ideal "tearing lines" along which the bag tends to separate under stress. In fact, the sealed fold at the center of the gusset is the point of greatest vulnerability to failure of the bag in use. Such seals were not present when bags were made from a seamless tube by the prior, less efficient process. Hence, the improved process whereby bags are made more efficiently and inexpensively by forming plural tubes in parallel from a single large diameter tube has typically produced bags which are severely limited in their ability to stand up to the stress encountered in normal use. To counter the effect of the weak, sealed fold, bags are sometimes made from thicker, tear-resistent materials. Of course, these materials are more expensive then the plastic which can be used with a seamless bag. Thus, the savings obtained using slit-sealed multiple webs are offset by the increased cost in materials.

OBJECT OF THE INVENTION

It is an object of the present invention to eliminate or minimize the tendency of bags utilizing one or more lengthwise seams to develop failures along the seams.

SUMMARY OF THE INVENTION

The present invention comprises a bag including a front wall and a rear wall and having an open mouth portion in which the front wall and rear wall are joined by pleated portions or gussets. The bag is manufactured so that a longitudinal, thermally welded seam is placed inside a portion of at least one of the gussets at a point other than the central fold. The bag preferably includes handles which are integral extensions of the front and rear walls and the gussets. The bag manufactured according to the principles of the present invention thus eliminates or minimizes failure of thermally welded seams.

The present invention also includes a method of manufacturing gusseted bags made of a thermoplastic material in the form of a tube, and having at least one elongated heat seal. The tube is expanded to form a generally cylindrical form. A gusseting force is then applied to the tube at a point displaced a predetermined distance from the elongated heat seal, so that the heat seal will be displaced a predetermined distance from the interior fold line of the gusset.

The invention also includes an apparatus for manufacturing plastic bags. The apparatus includes entry rollers for feeding the thermoplastic film tube. Inflating means for inflating the tube to form a cylinder are also provided. The cylinder passes gusseting means to distort the cylinder and form a gusset in the cylinder. The gusset is oriented about the cylinder such that the elongated seal is not positioned at the interior fold line of the gusset. The distorted cylinder then passes through exit rollers to form a gusseted tube. The gusseted tube is then introduced to heat sealing and cutting means for consecutively heat sealing and cutting sections of the gusseted tube to form individual bags.

DETAILED DESCRIPTION OF THE INVENTION

Figure 1:
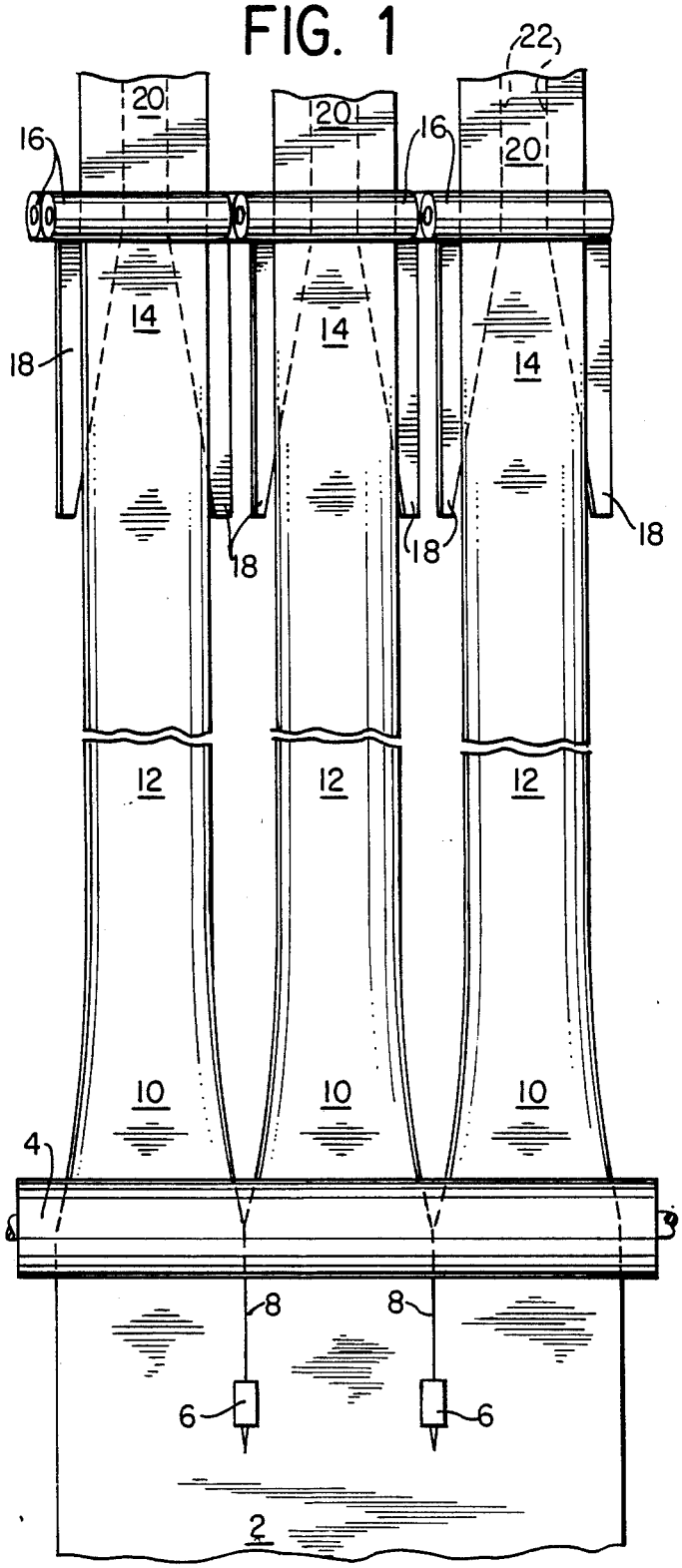
FIG. 1 shows a perspective view of the manufacturing process of the present invention.
Figure 2:
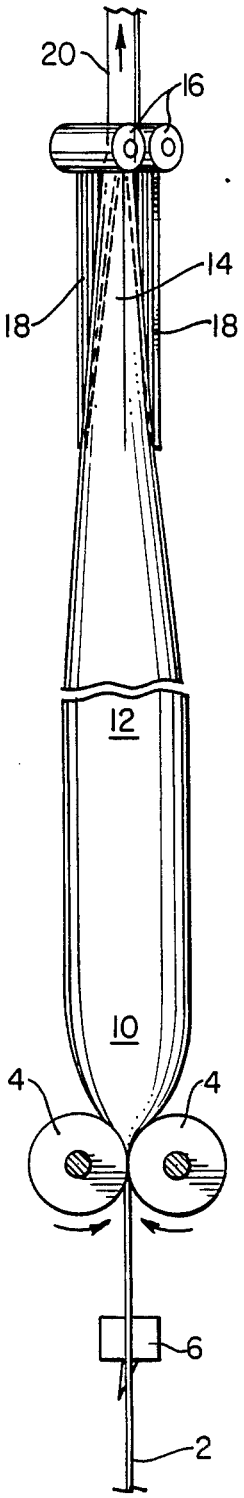
FIG. 2 shows a side view of the process shown in FIG. 1.

Referring to the Figures and particularly referring to FIG. 1, a perspective view of the manufacturing process of the present invention is shown. Continuous, flattened tube 2 of a thermoplastic film is drawn through a set of entry rollers 4.

The thermoplastic material used is generally polyethylene. Specifically, linear, low density polyethylene (LLDPE), low density polyethylene (LDPE), high density polyethylene (HDPE), and high molecular weight, high density polyethylene (HMW-HDPE) are preferred, but other thermoplastic materials including copolymers, can be used.

Before entry of flattened tube 2 between entry rollers 4, tube 2 is longitudinally slit and sealed into three separate tubes of equal diameter by two separate hot knives 6. Each hot knife 6 slices the two walls of tube 2 and then immediately seals the resulting two edges to form two separate seals for each hot knife 6.

Upon passing through entry rollers 4, three separate tubes 10 are individually inflated with gas to form cylinders 12. The gas can be nitrogen, argon or other inert gases; air and other gases can also be used. The individual cylinders 12 formed from tubes 10, are drawn into three separate sets of exit rollers 16. The seal created by entry rollers 4 and exit rollers 16 maintains the gas trapped in each cylinder 12. Thus, individual cylinders 12 need be inflated with gas only at the beginning of a production run. Once inflated, the cylinders can be maintained without further introduction of gas (unless a defect in the plastic causes the gas to escape).

Immediately before each cylinder 12 enters its respective set of exit rollers 16, the cylinder is distorted by gusseting boards 18. A pair of gusseting boards 18 is provided for each cylinder. The pair of boards is oriented such that external pressure may be applied to opposite sides of the circumference of each cylinder. The pair of gusseting boards form an open wedge such that the cylinder 12 being drawn between the boards 18 is gradually distorted until the maximum desired distortion is obtained. Exit rollers 16 are positioned immediately after gusseting boards 18 to collapse the distorted cylinders 14. Gusseted tubes 20 emerge from each pair of exit rollers 16. The central fold 22 of each gusseted tube 20 corresponds to the maximum point of distortion 19 of gusseting boards 18.

Figure 3:
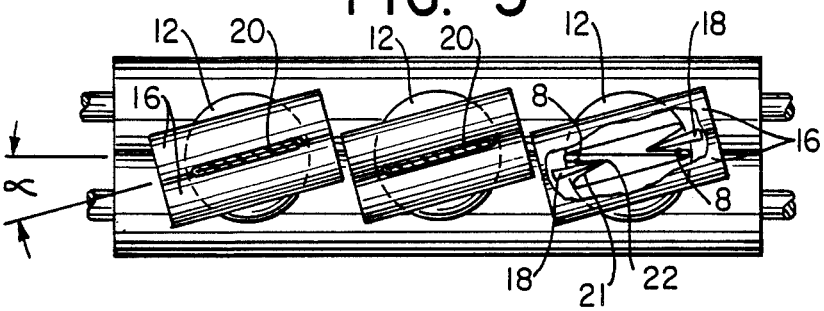
FIG. 3 shows a partially cut away, end view of the process shown in FIG. 1.

Each pair of gusseting boards 18 lies in a plane oriented parallel to the longitudinal axis of exit rollers 16. Each set of exit rollers 16 is skewed with respect to the longitudinal axis of entry rollers 4, as shown in FIG. 3, which is an end view of the apparatus shown in FIG. 1. The angle between the entry rollers and the exit rollers, is designated "angle $\alpha$" in FIG. 3. In the partial cut away shown in FIG. 3, distorted cylinder 14 is shown By orienting the gusseting boards 18 and exit rollers 16 at angle $\alpha$ to the longitudinal axis of entry rollers 4, the central fold 22 of the gusset 21 is created at a point other than at slit seal 8.

The exact position of slit seal 8 relative to central fold 22 can be varied by changing angle $\alpha$. For example, at angle $\alpha$ of 0 degrees, slit seals 8 will be positioned at central fold 22. This is the orientation used in the prior art. As angle $\alpha$ is increased, slit seal 8 will be positioned further from central fold 22. Angle $\alpha$ can be further increased until a maximum angle is reached, beyond which slit seals 8 will fall outside of gusset 21.

The range of angle $\alpha$ depends upon the circumference of cylinder 12, and the distance between central fold 22 of gusset 21 and external fold 28. In turn, the circumference (C) of cylinder 12 is determined by the desired width (W) of bag 23 and the depth (D) of each gusset. The circumference is thus defined as twice the width (W) plus four times the depth (D); or $C=2W+4D$. Angle $\alpha$ is then defined as:

$$\alpha = \frac{360(D)}{2(W) + 4(D)}$$

For example, a bag having a desired width of 10 inches and a desired gusset width of 2 inches could be constructed according to the present invention using an angle $\alpha$ defined as:

$$\alpha = \frac{360^\circ\,(2)}{2(10) + 4(2)} = \frac{720}{28} = 25.7^\circ$$

Thus $\alpha$ can be set at $0^\circ < \alpha < 25.7^\circ$ in order to have slit seal 8 fall between central fold 22 and external fold 28.

Figure 4:
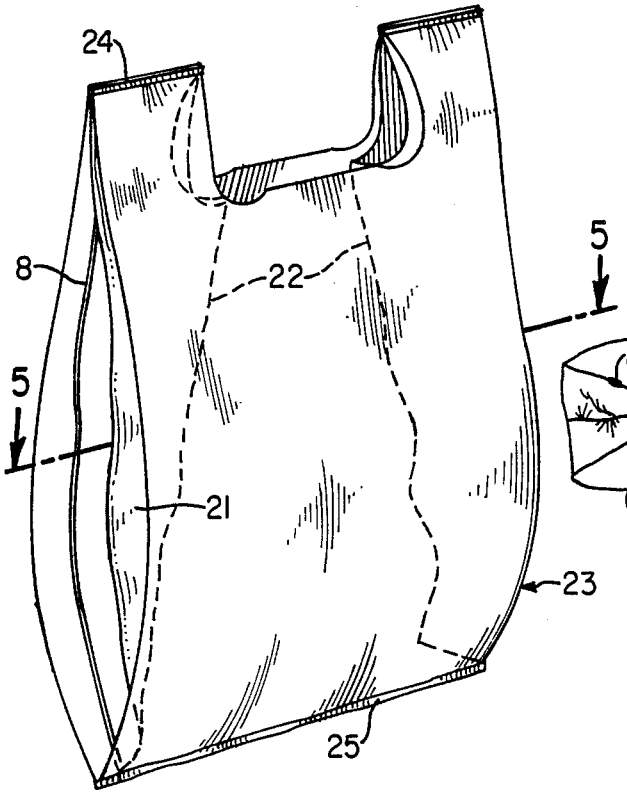
FIG. 4 is a perspective view of a "t-shirt" bag manufactured according to the present invention.

Gusseted tubes 20 emerging from exit rollers 16 are then heat sealed and cut in the transverse direction to form individual bags having heat seals at top 24 and bottom 25 of bag 23. Referring to FIG. 4, a handle 26 is created by die cutting a portion from the bag 23.

Figure 5:
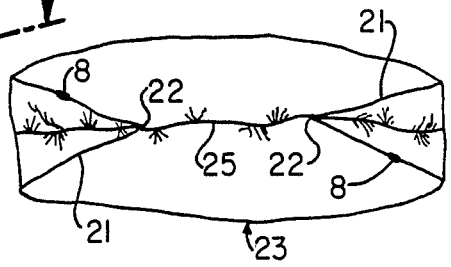
FIG. 5 is a top view of the bag of FIG. 4 taken along the line 5—5.

The cross-sectional view of bag 23 shown in FIG. 5 indicates the position of two slit seals 8 along the side of the gusset wall. Slit seals 8 are preferably oriented at any point along the walls of the gusset 21 except for central fold 22 or external folds 28. Positioning slit seals along the gusset walls ensures that slit seals 8 will extend from top seal 24 to bottom seal 25 of bag 23. This configuration will place a minimum of stress on slit seal 8 and a stronger plastic bag is thus obtained.

What is claimed is:

1. A plastic bag comprising:

a tube of thermoplastic film, having at least one longitudinal slit seal extending the length of the tube;

a pair of opposing gussets provided in said tube, each gusset having a central fold, said gussets oriented about said tube such that said longitudinal slit seal is not positioned at the central fold or external fold of either gusset;

transverse heat seals provided at the top and bottom of said bag, said bottom and top transverse heat seals intersecting said longitudinal slit seal; and two opposing bag handles defined by cutting an opening in said bag at said top transverse heat seal, each handle including an uncut portion of said top transverse heat seal, and at least one handle including said longitudinal slit seal extending from said transverse bottom heat seal to the uncut portion of said top transverse heat seal in said handle.

* * * * *